United States Patent [19]

Matsumoto et al.

[11] Patent Number: 4,724,411

[45] Date of Patent: Feb. 9, 1988

[54] CIRCUIT BREAKER

[75] Inventors: Yoshiaki Matsumoto; Shigeru Matsumoto, both of Fukuyama, Japan

[73] Assignee: Mitsubishi Denki Kabushiki Kaisha, Tokyo, Japan

[21] Appl. No.: 882,673

[22] Filed: Jul. 7, 1986

[30] Foreign Application Priority Data

Jul. 8, 1985 [JP] Japan ..... 60-104418[U]

[51] Int. Cl.[4] ..... H01H 9/00

[52] U.S. Cl. ..... 335/172; 335/10; 335/8; 337/45; 200/50 A

[58] Field of Search ..... 335/172, 8, 9, 10; 337/45, 46, 47, 48, 49, 50; 200/50 A, 50 C, 337

[56] References Cited

U.S. PATENT DOCUMENTS 2,689,287 9/1954 Schleicher ..... 337/46
3,125,653 3/1964 Cole et al. ..... 335/10

FOREIGN PATENT DOCUMENTS 788550 6/1968 Canada .

*Primary Examiner*—E. A. Goldberg
*Assistant Examiner*—Lincoln Donovan
*Attorney, Agent, or Firm*—Lowe, Price, LeBlanc, Becker & Shur

[57] ABSTRACT

A circuit breaker has a metal frame (10) disposed on a base of a housing. A trip-bar (6) made of molded plastic of like material is rotatably held on the frame (10) by insertion of a trip-bar pin (15) into a center through-hole provided on the trip-bar, and pinchers (14,14) of the trip-bar (6) pinch the trip-bar pin by elasticity of the plastic material to hold the same in place with very little lateral play.

4 Claims, 8 Drawing Figures

CIRCUIT BREAKER

FIELD OF THE INVENTION AND RELATED ART STATEMENT

1. Field of the Invention

The present invention relates to a circuit breaker, and especially to a circuit breaker having a trip-bar which is driven by a releasing mechanism.

2. Description of the Related Art

A conventional circuit breaker is illustrated in FIG. 1 and FIG. 2. FIG. 1 is a cross-sectional side view of a conventional circuit breaker, and FIG. 2 is a cross-sectional front view illustrating the position of a trip-bar on a base of a conventional circuit breaker.

As shown in FIG. 1, the conventional circuit breaker comprises a housing 1 including a base 1*a* and a cover 1*b*, a handle 2 for setting the circuit breaker by manual action, a link mechanism 3 which that comprises link levers 3*a*, 3*b*, 3*c*, 3*d*, 3*e*, 3*f* and other levers not shown in the figures, a movable contact 4 and a fixed contact 5. A trip-bar 6 is held rotatably at both its ends by metal bushes 7, 7 on base 1*a* of the housing 1, as best seen in FIG. 2. The trip-bar 6 is made of an insulating material. A plunger 8*a*, of an electromagnet 8 of a magnetic tripping mechanism, implicates a fork 6*b* of the trip-bar 6. An adjusting screw 9*a*, of a bi-metal element 9 of a thermal tripping mechanism, touches an arm part 6*c* of the trip-bar 6.

In such a conventional circuit breaker, a movable contact 4 is driven by the action of the handle 2, and contact point 4*a* of the movable contact 4 and contact point 5*a* of the fixed contact 5 change from an "on" to an "off" state, and vice versa. When an overcurrent flows in a circuit coupled to the circuit breaker of FIG. 1 during its "closed" state, the bi-metal element 9 bends due to heating due to the over current, and the arm part 6*c* of trip-bar 6 is pushed by adjusting screw 9*a* of the bi-metal element 9. Accordingly, movable contact 4 is separated from the fixed contact 5 by rotation of the trip-bar 6 via the link mechanism 3. On the other hand, when a large current flows through the circuit breaker of FIG. 1 in its closed state, plunger 8*a* of the magnet 8 is attracted and charged, and fork 6*b* of the trip-bar 6 is drawn below, so that movable contact 4 is separated from the fixed contact 5 by rotation of the trip-bar 6, by intermediation of link mechanism 3.

As mentioned above, in the conventional circuit breaker, the trip-bar 6 is held on the base 1*a*, and such a trip-bar 6 and base 1*a* are both formed of molded plastic parts. Accordingly, if the trip-bar dimensions are imprecise, there may be a problem of instability in the tripping characteristic of the circuit breaker caused by variation in the positions of the trip-bar 6 and the bi-metal 9.

OBJECT AND SUMMARY OF THE INVENTION

The purpose of the present invention is to provide an improved circuit breaker having a stable tripping characteristic, by precisely setting the positions of a trip-bar and a coacting bi-metal element therein.

A circuit breaker in accordance with the present invention comprises:

a housing having a base, a frame having two side plates opposing each other and disposed on the housing base, the side plates each having a hole disposed to be paired in opposing relationship, a trip-bar which has a center through-hole disposed at the center lengthwise of the trip-bar and two cutaway portions disposed at a predetermined distance apart corresponding to the width of the frame, to be rotatably held by the frame, and a trip-bar pin inserted into the center through-hole of the trip-bar and the two holes on the side plates of the frame for rotatably holding the trip-bar in the frame.

In another aspect of the invention, two pinchers, optionally with samll inwardly directed projections, are provided in said trip-bar for pinching the trip-bar pin.

DESCRIPTION OF THE PREFERRED EMBODIMENTS

A preferred embodiment of a circuit breaker in accordance with the present invention is described in the following with reference to FIGS. 3–8.

Figure 1:
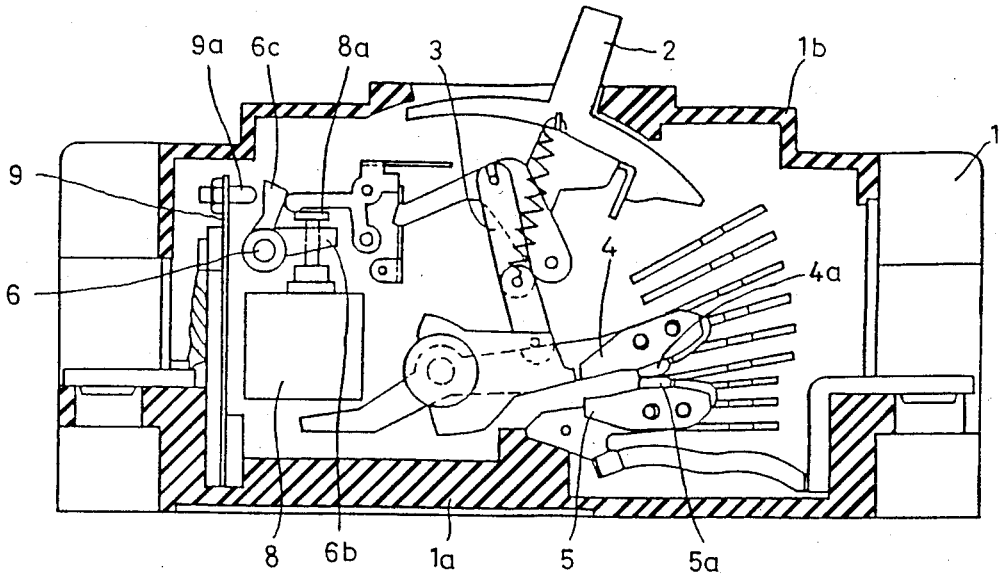
FIG.1 (Prior Art)
FIG. 1 is the cross-sectional side view showing a conventional circuit breaker.
Figure 2:
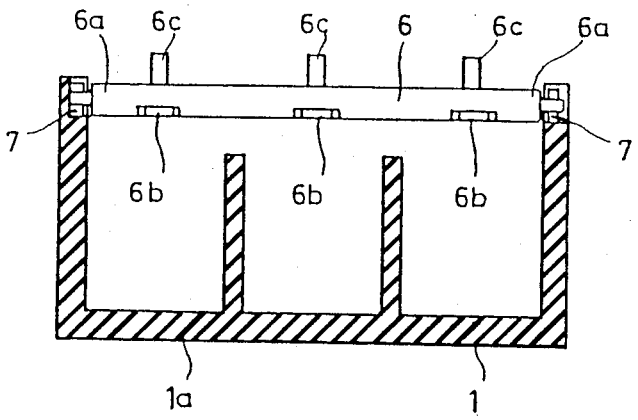
FIG.2 (Prior Art)
FIG. 2 is the cross-sectional front view showing the position of a trip-bar on the base of the conventional circuit breaker of FIG. 1.
Figure 3:
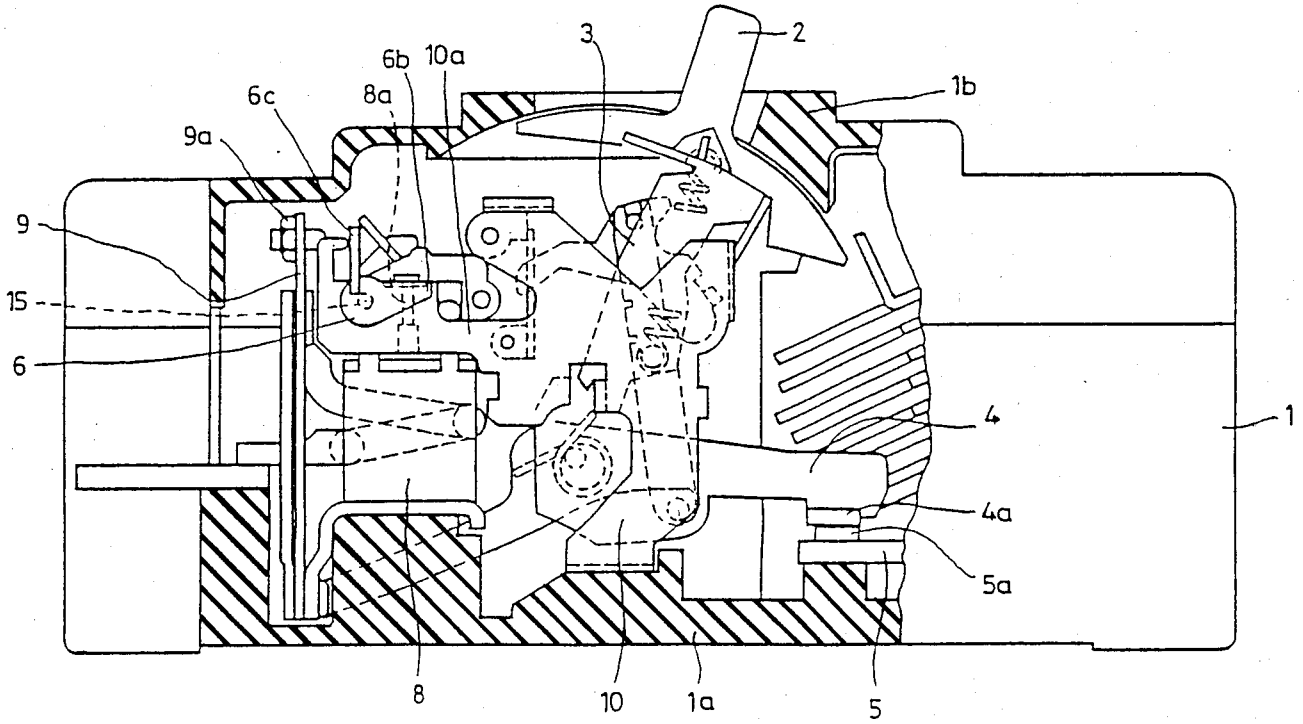
FIG. 3 is a cross-sectional side view showing an improved circuit breaker in accordance with the present invention.

As best seen in FIG. 3, a circuit breaker in accordance with the present invention comprises a housing 1 which includes a base 1*a* and a cover 1*b*, a handle 2, a link mechanism 3 comprising link levers (not specifically identified), a movable contact 4 and a fixed contact 5.

Figure 4:
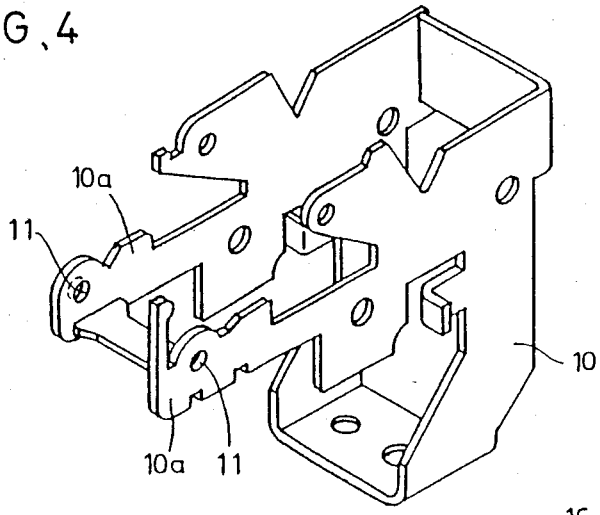
FIG. 4 is a perspective view of a frame of the circuit breaker in accordance with the present invention.

A trip-bar 6 is rotatably held by a frame 10, and the frame 10 is fixed on the base 1*a* of the housing 1. The frame 10 has two side plates 10*a*, and 10*a* which oppose each other as shown in FIG. 4. Furthermore, two holes 11 and 11 are respectively disposed on both side plates 10*a* and 10*a* opposite to each other. A trip-bar pin 15 is to be inserted through these holes 11 and 11.

Figure 5:
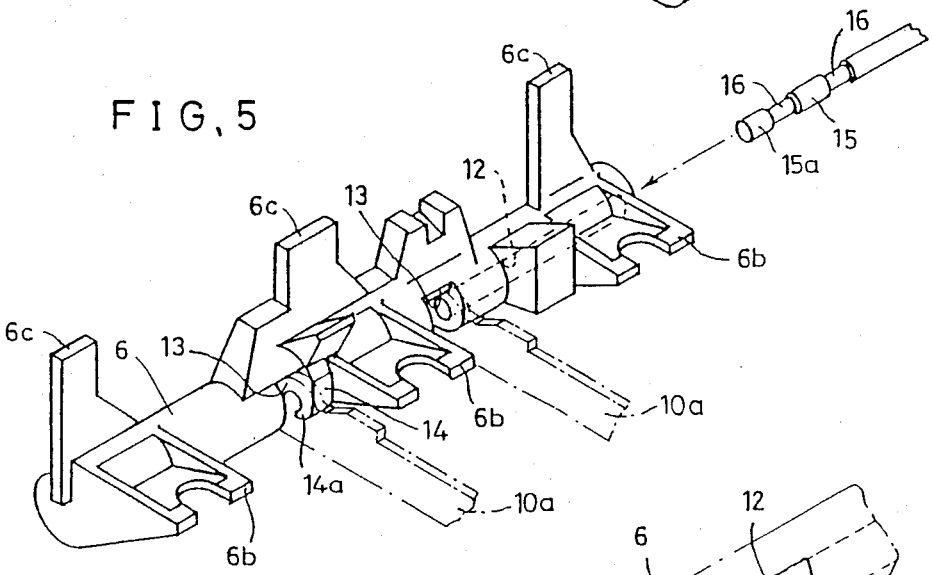
FIG. 5 is a perspective view illustrating a trip-bar and a trip-bar pin of the circuit breaker of FIG. 3 in accordance with the present invention.
Figure 6:
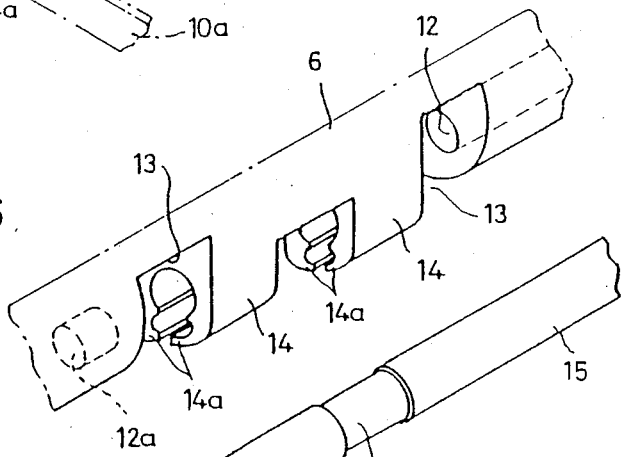
FIG. 6 is a magnified perspective view showing structural details of the trip-bar of the circuit breaker in accordance with the present invention.
Figure 7:
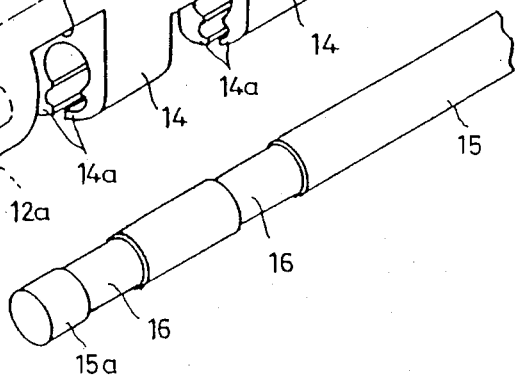
FIG. 7 is a magnified perspective view showing structural details of the trip-bar pin of the circuit breaker in accordance with the present invention.

As best seen in FIG. 5, the trip-bar 6 has three arms 6*c*, three forks 6*b* and a center through-hole 12 into which the trip-bar pin 15 is to be inserted. Two cutting parts 13 and 13 are disposed with a predetermined pitch lengthwise of the trip-bar 6. Such a predetermined pitch is selected to correspond to the width of the frame 10, and the assembling relation of the trip-bar 6 and the frame 10 is shown by single-dotted chain lines 10*a* and 10*a* in FIG. 5. Between cutaway portions 13 and 13 of trip-bar 6, two pinching parts 14 and 14 with pinchers 14*a* thereon (See FIG. 8) are disposed for pinching thereby of a trip-bar pin 15, to hold the latter to the trip-bar 6. The trip-bar 6 is generally made of molded plastic, and the pincher portion therefore has appropriate elasticity to grip trip-bar pin 15.

The top part 15*a* of trip-bar pin 15 fits into the bottom part 12*a* of the center hole 12 in trip-bar 6, and shallow grooves 16 and 16, which are portions of smaller diameter or offset parts of the trip-bar pin 15, are pinched by the pinchers 14 and 14.

Setting up of the circuit breaker is practiced as follows. The trip-bar 6 is placed on the frame 10 with coincidence of the cutting parts 13 and 13 with the side plates 10*a* and, 10*a* on both sides. Coincidence of the holes 11 and 11 on the side plates 10*a* and 10*a* with the center through-hole 12 of the trip-bar 6 is also obtained. After this setting, the trip-bar pin 15 is inserted into the center hole 12 in the arrow-marked direction per FIG. 5. As a result, the trip-bar pin 15 is rotatably supported by the holes 11 and 11 on both side plates 10*a* and 10*a*, and the trip-bar 6 is fixed on the trip-bar pin 15 as shown in FIG. 3. Accordingly, the trip-bar 6 can be rotated while being held in the holes 11 in the side plates 10*a* of the frame 10.

In the above-mentioned embodiment, since the trip-bar 6 pinches the trip-bar pin 15 by pinchers 14*a* of the pinching part 14, a sufficient strength for fixing together of the trip-bar 6 and the trip-bar pin 15 is obtained, and trip-bar 6 does not become loose in supporting the frame 10. Furthermore, by fitting the grooves 16 and 16 into the pinchers 14*a* and 14*a*, looseness or play in the relative axial positions between the trip-bar 6 and the trip-bar pin 15 can be minimized, and high prevision positioning of the trip-bar 6 of the circuit breaker is achieved.

Figure 8:
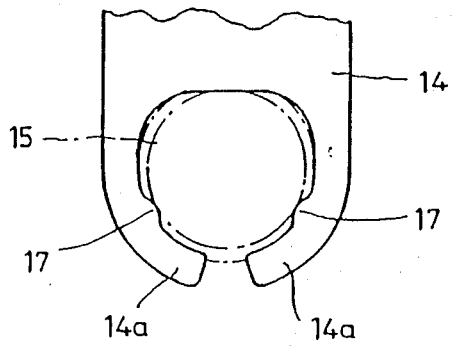
FIG. 8 is a side view illustrating pinching of the trip-bar pin by a pincher in a circuit breaker in accordance with the present invention.

FIG. 8 shows another embodiment, wherein projections 17 and 17 provided at inside surfaces of both pinchers 14*a* and 14*a* prevent slipping-off of the trip-bar pin 15 from the trip-bar 6, and the holding strength of the trip-bar 6 with respect to the trip-bar pin 15 can be increased.

When the holes 11 in the frame 10 are manufactured by metal presswork, the holes 11 are precisely positioned on the frame 10. As a result, leaning of the trip-bar 6 against the frame 10 can be substantially eliminated. Although in the above-mentioned embodiments the trip-bar 6 has the pinchers 14*a*, and the trip-bar pin 15 has grooves 16, these pinchers 14*a* and grooves 16 are not necessary for a realization of the benefits of this invention.

What is claimed is:

1. A circuit breaker, comprising:

a housing having a base;

a frame having two side plates opposing each other and disposed on said base of said housing, said side plates each having a hole disposed to be paired in opposing relationship;

a trip-bar formed to have a center through-hole disposed at the center lengthwise of said trip-bar and two cutaway portions disposed at a predetermined distance apart corresponding to the width of said frame with one of said side plates of said frame being located within a corresponding cutaway portion of said trip-bar, said trip-bar being rotatably supportable by said frame; and a trip-bar pin, inserted into said center through-hole of said trip-bar and said pair of opposing holes in said side plates of said frame, whereby said trip-bar is rotatably supported by said frame.

2. A circuit breaker in accordance with claim 1, wherein:

said trip-bar is formed to have two pinchers for respectively pinching said trip-bar pin disposed between said two cutaway portions of said trip-bar.

3. A circuit breaker in accordance with claim 1, wherein:

said trip-bar is formed to have two grooves which are disposed for pinching thereat by said pinchers.

4. A circuit breaker in accordance with claim 3, wherein:

said pinchers are each provided with two projections directed radially inward of said trip-bar pin pinched thereby at said grooves.

* * * * *